US009937612B2

(12) United States Patent
Bito et al.

(10) Patent No.: US 9,937,612 B2
(45) Date of Patent: Apr. 10, 2018

(54) IMPACT TOOL

(71) Applicant: MAKITA CORPORATION, Anjo-shi, Aichi (JP)

(72) Inventors: Shinya Bito, Anjo (JP); Masanori Furusawa, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 368 days.

(21) Appl. No.: 14/842,265

(22) Filed: Sep. 1, 2015

(65) Prior Publication Data

US 2016/0067856 A1 Mar. 10, 2016

(30) Foreign Application Priority Data

Sep. 5, 2014 (JP) ..... 2014-181640

(51) Int. Cl.

| | |
|---|---|
| ***B25D 17/08*** | (2006.01) |
| ***B25D 17/00*** | (2006.01) |
| ***B25D 11/00*** | (2006.01) |
| ***B25D 11/04*** | (2006.01) |

(Continued)

(52) U.S. Cl.

CPC ..... *B25D 17/005* (2013.01); *B25D 11/005* (2013.01); *B25D 11/04* (2013.01); *B25D 17/082* (2013.01); *B25D 17/24* (2013.01); *B25D 11/125* (2013.01); *B25D 17/08* (2013.01); *B25D 2211/068* (2013.01); *B25D 2217/0088* (2013.01); *B25D 2222/57* (2013.01); *B25D 2250/345* (2013.01); *B25D 2250/371* (2013.01)

(58) Field of Classification Search

CPC ..... B25D 11/00; B25D 11/005; B25D 11/125; B25D 9/00; B25D 17/005; B25D 17/08; B25D 17/082; B25D 17/10; B25D 17/043; B25D 17/24; B25D 2217/0088

USPC ..... 173/48, 109, 114, 201, 210, 211, 132, 173/162.1, 128, 117; 279/19.1

See application file for complete search history.

(56) References Cited

U.S. PATENT DOCUMENTS

| | | | | |
|---|---|---|---|---|
| 1,632,837 A | | 6/1927 | Hansen | |
| 1,901,779 A | * | 3/1933 | Skeel | B25D 11/06 173/201 |

(Continued)

FOREIGN PATENT DOCUMENTS

| | | |
|---|---|---|
| DE | 2 207 962 A1 | 8/1972 |
| DE | 10 2009 008 191 A1 | 8/2010 |

(Continued)

OTHER PUBLICATIONS

Oct. 26, 2017 Office Action issued in German Patent Application No. 10 2015 011 738.6.

(Continued)

*Primary Examiner* — Scott A. Smith
(74) *Attorney, Agent, or Firm* — Oliff PLC

(57) ABSTRACT

It is an object of the invention to provide an impact tool having a rational mechanism in an idling state. According to the representative invention, in an idling state defined as a state in which a tool accessory 119 is not pressed against a workpiece and an impact bolt 145 transmits a striking force to the tool accessory 119, the tool accessory retainer 510 moves with respect to a tool accessory holder 117 by movement of the tool accessory 119 in the longitudinal direction, so that the striking force is cushioned.

9 Claims, 14 Drawing Sheets

(51) Int. Cl.
*B25D 17/24* (2006.01)
*B25D 11/12* (2006.01)

(56) References Cited

U.S. PATENT DOCUMENTS 4,014,392 A * 3/1977 Ross ..... B25D 11/125 173/117
4,548,278 A * 10/1985 Gidlund ..... B22D 31/00 173/121
5,871,059 A * 2/1999 Shibata ..... B25D 11/005 173/133
7,096,973 B2 * 8/2006 Ikuta ..... B25D 11/125 173/162.1
7,124,840 B2 * 10/2006 Miyakawa ..... B25D 17/24 173/162.1
7,204,322 B2 * 4/2007 Sakai ..... B25D 11/125 173/117
7,413,026 B2 * 8/2008 Berghauser ..... B25D 17/08 173/109
7,726,413 B2 * 6/2010 Berghauser ..... B25D 17/082 173/171
7,819,203 B2 * 10/2010 Sato ..... B25D 17/11 173/128
8,037,947 B2 * 10/2011 Miwa ..... B25D 11/005 173/128
8,590,633 B2 * 11/2013 Berghauser ..... B25D 17/06 173/109
9,067,312 B2 6/2015 Koch et al.
2002/0134563 A1 * 9/2002 Stirm ..... B25D 16/00 173/201
2004/0222001 A1 * 11/2004 Ikuta ..... B25D 11/125 173/210
2007/0017684 A1 * 1/2007 Stirm ..... B25D 11/062 173/109
2008/0006418 A1 1/2008 Berghauser et al.
2008/0047723 A1 * 2/2008 Kamegai ..... B25D 11/062 173/109
2009/0032275 A1 * 2/2009 Ikuta ..... B25D 17/24 173/117
2010/0051304 A1 * 3/2010 Aoki ..... B25D 17/24 173/114
2011/0226500 A1 * 9/2011 Furusawa ..... B25D 17/24 173/110

FOREIGN PATENT DOCUMENTS

EP 1 992 453 B9 4/2012
GB 547017 A 8/1942
GB 1 424 473 A 2/1976
JP S62-72078 U 5/1987
JP S64-087168 A 3/1989
JP H11-058262 A 3/1999
JP 2002-219668 A 8/2002
JP 2008-279545 A 11/2008

OTHER PUBLICATIONS

Jan. 24, 2018 Office Action issued in Japanese Patent Application No. 2014-181640.

* cited by examiner

IMPACT TOOL

TECHNICAL FIELD

The present invention relates to an impact tool for performing a prescribed hammering operation on a workpiece by moving a tool accessory in a longitudinal direction.

BACKGROUND ART

As an example of an impact tool which is capable of cushioning an impact applied by an impact bolt in a so-called idling state, Japanese non-examined laid-open Patent Publication No. 2002-219668 discloses a technique for providing a first cushioning member and a second cushioning member formed by a rubber sleeve and a rubber ring, respectively, in the impact tool.

In this known impact tool, in a state in which the impact tool is lifted up by a user and a tool accessory is separated from the workpiece, the impact bolt may be driven by driving of a striker. In this case, when the impact bolt collides with a tool holder, the impact bolt may be bounced off toward the striker by the first and second cushioning members formed of rubber. In such a condition, the striker is driven again by a piston and thus the impact bolt is continuously driven even though the tool accessory is separated from the workpiece. Therefore, further improvement is required in this point.

SUMMARY OF THE INVENTION

Problem to be Solved by the Invention

Accordingly, it is an object of the present invention to provide an impact tool having a rational mechanism as a solution to a problem arising in a state in which the tool accessory is separated from a workpiece.

Representative Embodiment of the Invention

In order to solve the above-described problem, according to the present invention, an impact tool is provided which performs a prescribed hammering operation on a workpiece by moving a tool accessory in a longitudinal direction of the tool accessory. The impact tool has a striker that linearly moves in the longitudinal direction, an impact bolt that is driven by the striker and transmits a striking force to the tool accessory, a tool accessory holder that holds the tool accessory such that the tool accessory can move in the longitudinal direction, a tool accessory retainer that is provided in an end region of the tool accessory holder and prevents the tool accessory from coming off the tool accessory holder, and an elastic element that connects the tool accessory holder and the tool accessory retainer such that the tool accessory holder and the tool accessory retainer can move in the longitudinal direction with respect to each other.

In an idling state defined as a state in which the tool accessory is not pressed against the workpiece and the impact bolt transmits the striking force to the tool accessory, the tool accessory retainer moves with respect to the tool accessory holder by movement of the tool accessory in the longitudinal direction, so that the striking force is cushioned.

According to the impact tool of the present invention, with the structure in which the striking force is cushioned by movement of the tool accessory retainer with respect to the tool accessory holder in the idling state, the impact caused by collision of the tool accessory with the tool accessory retainer is cushioned. Therefore, in the idling state, the striker can be prevented from moving in an opposite direction from the tool accessory via the impact bolt when the tool accessory is bounced off the tool accessory retainer. Specifically, according to the impact tool of the present invention, a condition in which the striker, the impact bolt and the tool accessory are not driven can be formed when the tool accessory is not pressed against the workpiece.

Further, even when the tool accessory holder and the tool accessory retainer move with respect to each other by collision of the tool accessory with the tool accessory retainer, the tool accessory holder and the tool accessory retainer can be returned to their initial positions by the elastic element. Therefore, when the user starts the hammering operation again from the idling state, the impact tool can immediately perform the hammering operation.

In an aspect of the solution in the impact tool according to the present invention, the impact bolt is avoided from coming in contact with the tool accessory holder in the longitudinal direction in the idling state. Thus, the striking force of the impact bolt can be prevented from being transmitted to the tool accessory holder in the idling state.

According to the impact tool of this aspect, in the idling state, the impact bolt can be prevented from being bounced off the tool accessory holder and moving in the opposite direction from the tool accessory. Specifically, a condition in which the impact bolt is not driven can be formed in the idling state.

In an aspect of the solution in the impact tool according to the present invention, the elastic element may be formed by a coil spring.

In an aspect of the solution in the impact tool according to the present invention, the tool accessory retainer has a retainer body and a retainer shaft. The tool accessory retainer may be configured to be rotatable around the retainer shaft between a replacement position for attaching and detaching the tool accessory to and from the tool accessory holder and an operation position for preventing the tool accessory from coming off the tool accessory holder.

According to the impact tool of this aspect, the user can immediately perform the hammering operation by turning the tool accessory retainer after replacement of the tool accessory.

In an aspect of the solution in the impact tool according to the present invention, the retainer shaft can prevent the tool accessory from coming off the tool accessory holder by engagement with the tool accessory when the tool accessory moves in the longitudinal direction.

In an aspect of the solution in the impact tool according to the present invention, the tool accessory defines a first tool accessory that has a flange on the tool accessory body and a second tool accessory that has a notch extending in the longitudinal direction in the tool accessory body and has a pair of walls formed on both ends of the notch. In the tool accessory retainer, the retainer body has a first contact part that comes in contact with the flange when the first tool accessory moves in the longitudinal direction, and the retainer shaft has a second contact part that comes in contact with the walls when the second tool accessory moves in the longitudinal direction.

By provision of such a structure, the impact tool may be configured such that the first and second tool accessories can be replaced with each other.

According to the impact tool of this aspect, by provision of the retainer having the first and second contact parts, the user can appropriately and selectively use the first and second tool accessories.

In an aspect of the solution in the impact tool according to the present invention, the impact tool may have a biasing element which pulls up the retainer shaft toward the tool accessory holder and thereby fixes the tool accessory retainer with respect to the tool accessory holder in the operation position. The biasing element can also serve as the elastic element.

According to the impact tool of this aspect, the elastic element for cushioning the striking force and the biasing element for fixing the tool accessory retainer and the tool accessory holder in the operation position are formed as a single structure, so that a more rational structure can be provided as the impact tool.

In an aspect of the solution in the impact tool according to the present invention, the impact tool has a striker cushioning part for cushioning an impact caused by the striker when the striker moves toward the tool accessory. The striker cushioning part also serves as a positioning element when the impact bolt is driven by the striker.

According to the impact tool of this aspect, with the structure in which the impact caused when the striker moves toward the tool accessory is cushioned, the striker is prevented from being bounced off and driven again. Specifically, a condition in which the striker is not driven can be formed when the tool accessory is not pressed against the workpiece.

Further, with the structure in which the striker cushioning part also serves as the positioning element, a more rational structure as the impact tool can be provided.

In an aspect of the solution in the impact tool according to the present invention, the striker cushioning part has a movable member that can move in the longitudinal direction. The movable member is moved in a direction away from the tool accessory when the striker comes in contact with the impact bolt, while the movable member is moved in a direction toward the tool accessory when pressed by the striker.

According to the impact tool of this aspect, the striker can be prevented from being bounced off by the movable member. Therefore, a condition in which the striker is not driven can be formed in the idling state.

Effect of the Invention

According to the present invention, an impact tool can be provided with a rational mechanism as a solution to a problem arising in an idling state.

DETAILED REPRESENTATIVE EMBODIMENT OF THE INVENTION

Embodiments of the present invention are now explained with reference to FIGS. 1 to 20. In the embodiments of the present invention, an electric hammer 101 which performs a prescribed hammering operation on a workpiece such as concrete by moving a hammer bit 119 in its longitudinal direction is explained as a representative example. The hammer bit 119 and the electric hammer 101 are example embodiments that correspond to the "tool accessory" and the "impact tool", respectively, according to the present invention.

Further, in the following description, the longitudinal direction of the hammer bit 119 is referred to merely as the "longitudinal direction".

First Embodiment

A first embodiment of the present invention is now described with reference to FIGS. 1 to 18.

Figure 1:
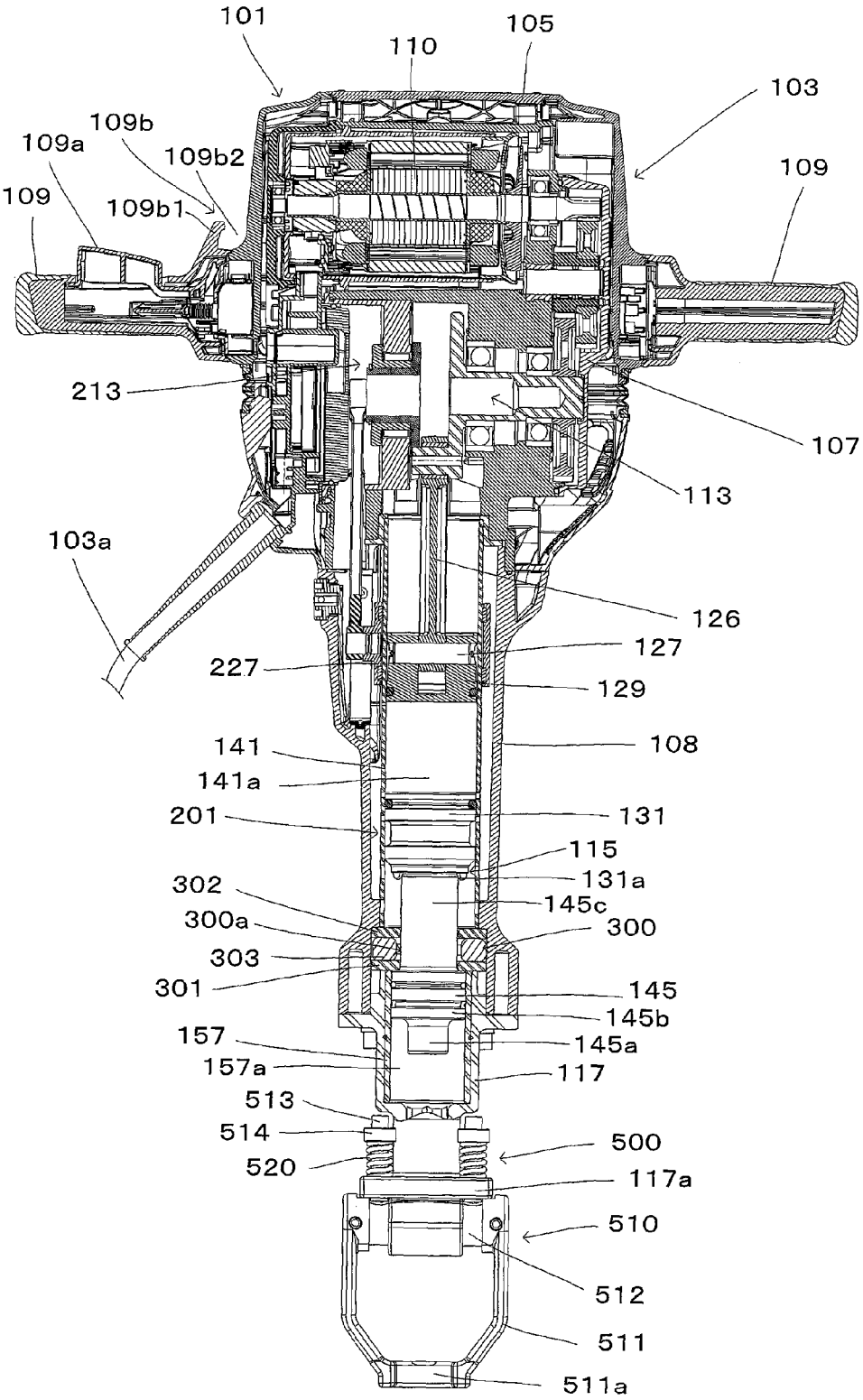
FIG. 1 is a partially cutaway sectional view showing the overall structure of an electric hammer according to a first embodiment of the present invention.

As shown in FIG. 1, the electric hammer 101 has a body 103 that forms an outer shell of the electric hammer 101. For the sake of convenience, the hammer bit 119 is not shown in FIG. 1. A tool holder 117 is provided in a front end region of the body 103 and holds the hammer bit 119 such that the hammer bit 119 can move in the longitudinal direction. The tool holder 117 is an example embodiment that corresponds to the "tool accessory holder" according to this invention. Further, for the sake of convenience, a lower side as viewed in FIG. 1 is referred to as a front side or front end side of the electric hammer 101 and an upper side as viewed in FIG. 1 is referred to as a rear side or rear end side of the electric hammer 101.

As shown in FIG. 1, the body 103 has a motor housing 105 that houses a driving motor 110, a gear housing 107, a handgrip 109, a barrel 108, the tool holder 117 and a retainer 510. A first motion converting mechanism 113 and a second motion converting mechanism 213 are housed in the gear housing 107 and a striking mechanism 115 is housed in the barrel 108 and the tool holder 117. The rotating output of the driving motor 110 is appropriately converted into linear motion by the first motion converting mechanism 113 and then transmitted to the striking mechanism 115. As a result, the hammer bit 119 generates an impact force in the longitudinal direction via the striking mechanism 115.

A user supports the electric hammer 101 by holding the handgrip 109 shown in FIG. 1 and energizes the driving motor 110 by operating an operation button 109*a*. The handgrip 109 has a cord holding part 109*b* which holds a power cord 103*a* for supplying power to the driving motor 110. The cord holding part 109*b* includes a projection 109*b*1 formed on the handgrip 109 and a space 109*b*2 formed between the projection 109*b*1 and the body 103. The user can perform a hammering operation more smoothly by holding the power cord 103*a* in the space 109*b*2 of the cord holding part 109*b*. For example, when the power cord 103*a* is held by the cord holding part 109*b*, the power cord 103*a* can be arranged to extend from a side of the electric hammer 101 opposite to the user toward the user. In this case, the power cord 103*a* can be positioned not to interfere with the hammer bit 119, so that the user can perform the hammering operation without caring about the position of the power cord 103*a* with respect to the hammer bit 119.

As shown in FIG. 1, the rotating output of the driving motor 110 is further converted appropriately into linear motion by the second motion converting mechanism 213 and then transmitted to a counter weight 227. The counter weight 227 reciprocates in the longitudinal direction in contact with an outer peripheral wall of a cylinder 141 and thereby reduces vibration caused by driving of the striking mechanism 115.

Further, as described below, the electric hammer 101 further has a first cushioning mechanism 300, a remaining space 400 and a second cushioning mechanism 500 in order to reduce an impact caused by driving of the striking mechanism 115.

Figure 2:
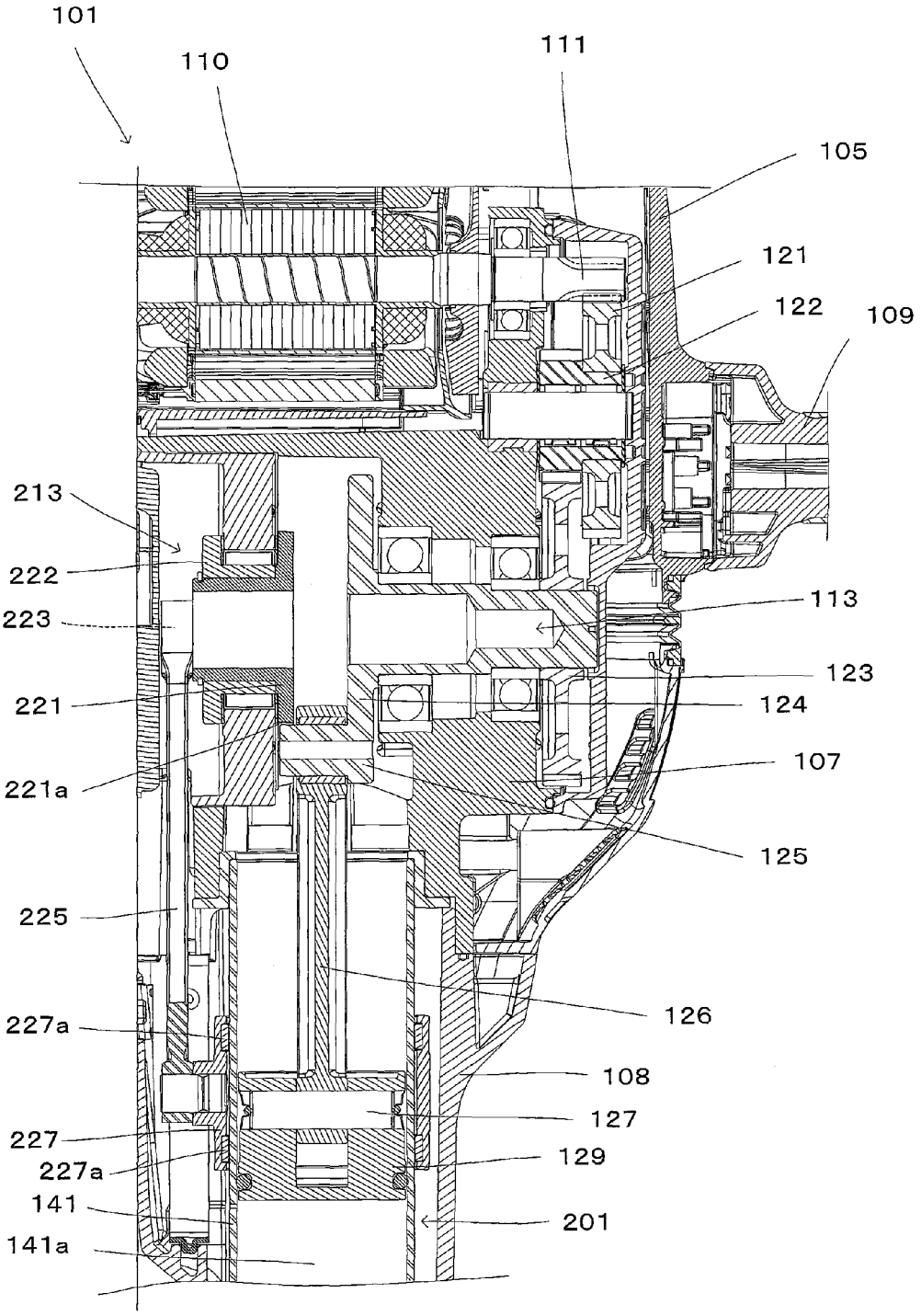
FIG. 2 is an enlarged sectional view showing first and second motion converting mechanisms in the electric hammer.

FIG. 2 is an enlarged sectional view showing detailed structures of the first motion. converting mechanism 113 and the second motion converting mechanism 213. The first motion converting mechanism 113 has a driving gear 121 that is rotationally driven by a rotary shaft 111 of the driving motor 110, an intermediate gear 122 that rotates together with the driving gear 121, a driven gear 123 that is engaged with the intermediate gear 122, a first crank disk 124 that rotates together with the driven gear 123, a first eccentric shaft 125 (crank pin) that is displaced from a center of rotation of the first crank disk 124 and disposed on its peripheral edge, and a first connecting rod 126 that has one end loosely fitted on the first eccentric shaft 125 and the other end loosely fitted in a driving element in the form of a piston 129 via a first connecting shaft 127.

As shown in FIG. 1, the striking mechanism 115 mainly includes a striker 131 that is slidably disposed within a bore of the cylinder 141 together with the piston 129, and an impact bolt 145 that is slidably disposed within the tool holder 117 and transmits kinetic energy of the striker 131 to the hammer bit 119. Further, the barrel 108 is connected to the gear housing 107 and houses the cylinder 141. The striker 131 and the impact bolt 145 are example embodiments that correspond to the "striker" and the "impact bolt", respectively, according to the present invention.

The second motion converting mechanism 213 which causes the counter weight 227 to linearly reciprocate is shown in FIG. 2. The second motion converting mechanism 213 has a second crank disk 221, a third crank disk 222 that is fixedly mounted on the second crank disk 221, a second eccentric shaft 223 (crank pin) that is displaced from a center of rotation of the third crank disk 222 and disposed on a peripheral edge of the third crank disk 222, and a second connecting rod 225 that has one end loosely fitted on the second eccentric shaft 223 and the other end mounted to the counter weight 227.

The second crank disk 221 is arranged such that its rotation axis substantially coincides with a rotation axis of the first crank disk 124 of the first motion converting mechanism 113. The second crank disk 221 is loosely connected to the first eccentric shaft 125 via an engagement part 221*a* at a position displaced from its rotation axis. The third crank disk 222 is fixedly mounted onto the second crank disk 221 coaxially with the second crank disk 221. The counter weight 227 has a sliding guide 227*a* made of synthetic resin so as to easily slide on an outer periphery of the cylinder 141.

As described above, in this embodiment, power is taken out from the middle of a power transmission path of the first motion converting mechanism 113 which is driven by the driving motor 110, and the second motion converting mechanism 213 is driven by the power.

The striking mechanism 115 is now explained with reference to FIGS. 1 and 3.

As shown in FIG. 1, the striking mechanism 115 mainly includes the piston 129 that is vertically slid by the first motion converting mechanism 113, the striker 131, the cylinder 141 that slidably houses the piston 129 and the striker 131, the impact bolt 145 and a sleeve 157 that slidably houses the impact bolt 145.

The striker 131 is driven when the piston 129 is driven in the longitudinal direction by the first motion converting mechanism 113. Specifically, when the piston 129 is driven toward the hammer bit 119, air within a first air chamber 141*a* formed between the piston 129 and the striker 131 is compressed. Then, when the compressed air expands, the striker 131 is moved toward the hammer bit 119 and collides with the impact bolt 145, and the impact bolt 145 then moves the hammer bit 119. Thus, the hammer bit 119 is driven by impact.

When the electric hammer 101 performs a hammering operation, the hammer bit 119 is located in a lower position by its own weight. In this state, the user holds the handgrip 109 and places the body 103 in a lower position by utilizing its own weight. Specifically, the hammer bit 119 is relatively moved toward a rear end of the body 103. This state is referred to as a state in which the hammer bit 119 is pressed against a workpiece.

Then the hammer bit 119 pushes up the impact bolt 145 and the striker 131 rearward. In this state, when the piston 129 is driven rearward, negative pressure is generated in the first air chamber 141, so that the striker 131 is moved rearward. In this manner, during the hammering operation, the hammer bit 119 can be continuously driven by impact by reciprocating movement of the piston 129.

During the operation, however, the user may move with respect to the workpiece. At this time, the user holds the handgrip 109 and lifts the body 103, which causes the hammer bit 119 to be moved toward a front end of the body 103 by its own weight. By the movement of the hammer bit 119, the impact bolt 145 is moved toward the front end of the body 103. This state is referred to as a state in which the hammer bit 119 is not pressed against the workpiece.

As shown in FIG. 1, a first cushioning mechanism 300 is formed on a front end of the cylinder 141. The first cushioning mechanism 300 includes a front metal washer 301, a rear metal washer 302 and a rubber ring 303 disposed between the front metal washer 301 and the rear metal washer 302. The front metal washer 301, the rear metal washer 302 and the rubber ring 303 are ring-shaped such that the first cushioning mechanism 300 has a hole 300*a*. The first cushioning mechanism 300 is an example embodiment that corresponds to the "striker cushioning part" according to this invention.

When the striker 131 moves forward, a front region 131*a* of the striker 131 collides with the first cushioning mechanism 300. An impact caused by this collision is cushioned by the rubber ring 303. By such provision of the first cushioning mechanism 300 which cushions the impact caused by the striker 131, the striker 131 is prevented from bouncing off rearward.

As shown in FIG. 1, the impact bolt 145 has a first region 145*a* on the front side, a third region 145*c* on the rear side, and a second region 145*b* between the first region 145*a* and the third region 145*c*. Each of the first region 145*a*, the second region 145*b* and the third region 145*c* has a generally cylindrical shape, and the second region 145*b* has a larger diameter than the first region 145*a* and the third region 145*c*. Due to this structure, the second region 145*b* has a front end surface 145*b*1 and a rear end surface 145*b*2. Further, the third region 145*c* is inserted through the hole 300*a* of the first cushioning mechanism 300. The hole 300*a* has a slightly larger diameter than the third region 145*c*, so that the hole 300*a* can position the third region 145*c*. Thus, the first cushioning mechanism 300 also serves to position the impact bolt 145. The first cushioning mechanism 300 is an example embodiment that corresponds to the "positioning element" according to this invention.

Figure 3:
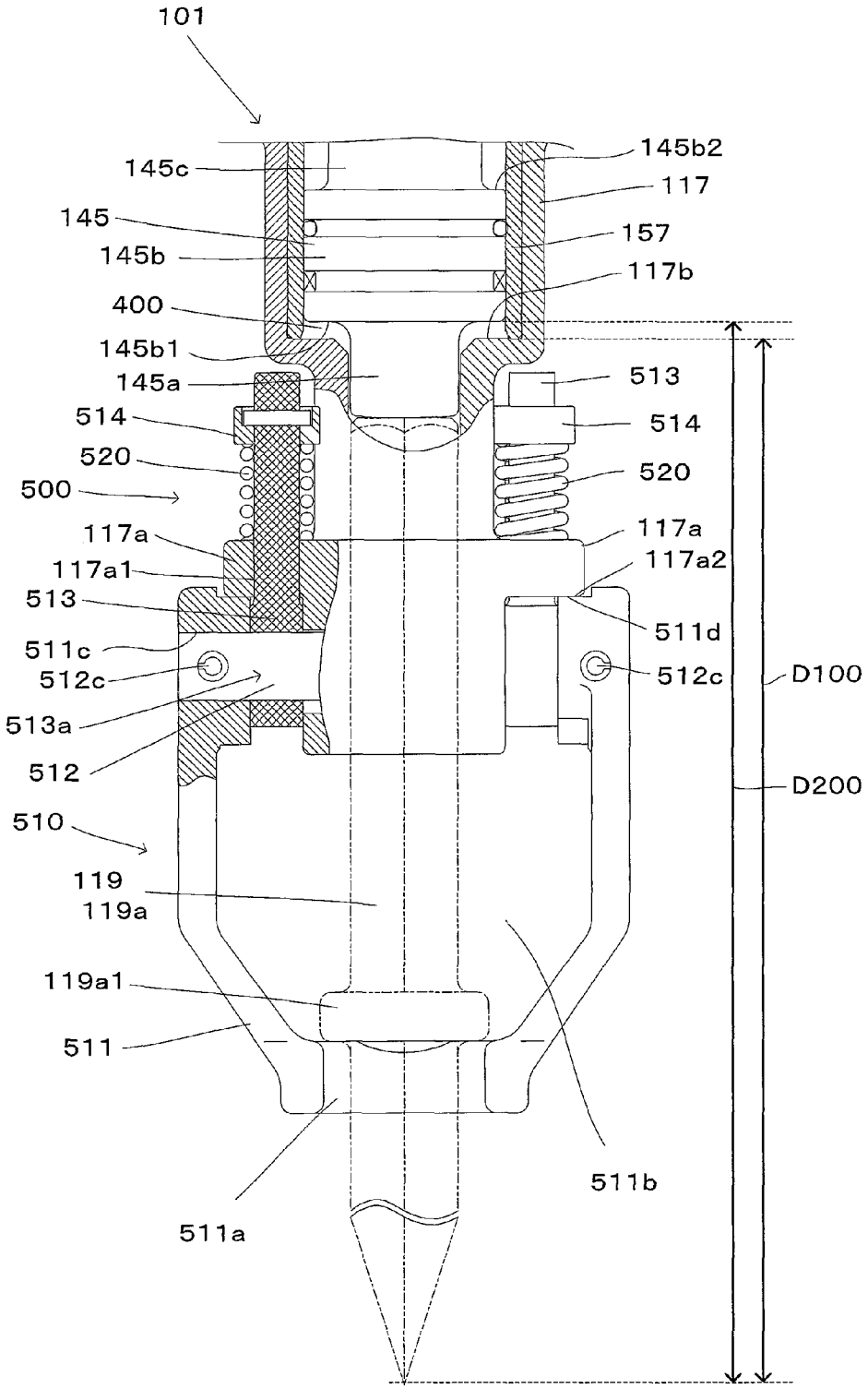
FIG. 3 is a partially cutaway enlarged view showing a retainer in the electric hammer.

FIG. 3 shows a state in which movement of the hammer bit 119 by the impact bolt 145 is completed. In this state, the front end surface 145*b*1 of the second region 145*b* of the impact bolt 145 does not come in contact with a front inner wall 117*b* of the tool holder 117. In other words, even if the impact bolt 145 is located in a position where movement of the hammer bit 119 is completed, a space can be maintained between the impact bolt 145 and the tool holder 117 in the sleeve 157. In the embodiments according to the present invention, the "space that is maintained between the impact bolt 145 and the tool holder 117 even if the impact bolt 145 is located in a position where movement of the hammer bit 119 is completed" is defined as a remaining space 400.

The remaining space 400 can cushion the impact which is directly applied to the tool holder 117 by the impact bolt 145. Further, by provision of such a structure, durability of the tool holder 117 can be improved.

The structure for forming the remaining space 400 is now explained. First, it is assumed that the hammer bit 119 and the impact bolt 145 are moved to a front end position under a "stationary condition". In this case, a distance between a tip of the hammer bit 119 and the front inner wall 117*b* of the tool holder 117 in the longitudinal direction is defined as a first distance D100. A distance between the tip of the hammer bit 119 and the front end surface 145*b*1 of the impact bolt 145 in the longitudinal direction is defined as a second distance D200. The remaining space 400 can be formed by setting the first distance D100 to be shorter than the second distance D200.

In the electric hammer 101 according to the first embodiment, when the hammer bit 119 performs a hammering operation, the tool holder 117 and the retainer 510 are moved with respect to each other, which is described below. Specifically, when the hammer bit 119 collides with the retainer 510, the retainer 510 is moved in a direction away from the tool holder 117. In such a state, the hammer bit 119 moves by movement of the retainer 510, and the impact bolt 145 moves toward the hammer bit 119 by following the movement of the hammer bit 119. At this time, a state in which the remaining space 400 does not exist may be caused by instantaneous contact of the front end surface 145*b*1 of the impact bolt 145 with the front inner wall 117*b* of the tool holder 117. However, it is only necessary for the remaining space 400 to satisfy that "the space exists between the front end surface 145*b*1 of the impact bolt 145 and the front inner wall 117*b* of the tool holder 117" in "a state in which forward movement of the hammer bit 119 by the impact bolt 145 is completed and the retainer 510 is not yet moved by the hammer bit 119".

As described below in detail with reference to FIGS. 5 to 18, the remaining space 400 has a specific function in an idling state defined as a state in which the hammer bit 119 is not pressed against the workpiece and the impact bolt 145 transmits a striking force to the hammer bit 119. This state may occur when the hammer bit 119 and the impact bolt 145 are not yet completely moved downward by their respective own weights immediately after the user lifts the body 103 upward. Even in this idling state, the piston 129 continues to be driven.

Specifically, when the hammer bit 119 is moved by the impact bolt 145 without being pressed against the workpiece, the impact bolt 145 cannot essentially return rearward because the hammer bit 119 is not pressed against the workpiece.

Even in such a case, however, if the remaining space 400 is not formed, the impact bolt 145 is bounced off rearward by collision with the tool holder 117. The bounced impact bolt 145 collides with the striker 131 and moves the striker 131 rearward. Then, the striker 131 is sucked by the negative pressure of the first air chamber 141*a* which is generated by rearward driving of the piston 129. Subsequently, the striker 131 is moved forward again by compression and expansion of the air in the first air chamber 141*a* which are caused by forward driving of the piston 129, and collides with the impact bolt 145. Specifically, if the remaining space 400 does not exist, the impact bolt 145 is bounced off by collision with the tool holder 117, which may cause the impact bolt 145 to continue to be driven and strike the hammer bit 119.

In the electric hammer 101 according to the embodiments of the present invention, however, the remaining space 400 is formed so that the "bouncing-off" of the impact bolt 145 in the idling state can be prevented.

The structure of the front end region of the electric hammer 101 is now explained with reference to FIGS. 3 and 4. The retainer 510 is connected to the front end region of the tool holder 117 such that it can move in the longitudinal direction with respect to the tool holder 117. Both of the tool holder 117 and the retainer 510 are made of metal. The retainer 510 is an example embodiment that corresponds to the "tool accessory retainer" according to this invention. As shown in FIG. 3, the retainer 510 has a retainer body 511 and a retainer shaft 512. The retainer body 511 and the retainer shaft 512 are example embodiments that correspond to the "retainer body" and the "retainer shaft", respectively, according to the present invention.

As shown in FIG. 3, the retainer body 511 is formed by a frame having an opening 511*b* in its central region. A curved part 511*a* is formed on one end (lower end as viewed in FIG. 3) of the retainer body 511, and the other end (upper end as viewed in FIG. 3) is connected to the retainer shaft 512. The retainer shaft 512 is inserted through a hole 511*c* formed through the other end region of the retainer body 511 and fastened to the retainer body 511 by fastening members 512*e* such as spring pins. Further, as described below with reference to FIGS. 5 to 18, the curved part 511*a* and the retainer shaft 512 form a contact part that comes in contact with a prescribed region of the hammer bit 119 when the hammer bit 119 moves in the longitudinal direction and thereby prevents the hammer bit 119 from coming off the tool holder 117.

In order to connect the retainer 510 and the tool holder 117, a shaft 513 is slidably inserted through a hole 117*a*1 of a projection 117*a* formed in a front end region of the tool holder 117. Then the retainer shaft 512 is inserted through a hole 513*a* formed in a front end region of the shaft 513.

A coil spring 520 is disposed around the shaft 513 inserted through the projection 117*a* of the tool holder 117 while exhibiting a biasing force in a direction of expansion by a spring receiving part 514 fixed to the shaft 513. Specifically, the coil spring 520 is disposed between the projection 117*a* and the spring receiving part 514, while exhibiting the biasing force in the direction of expansion.

By provision of such a structure, the retainer shaft 512 is pulled up rearward by the biasing force of the coil spring 520, so that a front region 117*a*2 of the projection 117 and a rear end region 511*d* of the retainer body 511 are held in contact with each other. Specifically, the tool holder 117 and the retainer 510 are movably connected to each other via the coil spring 520. At this time, the tool holder 117 and the retainer 510 are rotatably fixed to each other by the biasing force of the coil spring 520. The coil spring 520 is an example embodiment that corresponds to the "elastic element" and the "biasing element" according to this invention.

Further, as described below with reference to FIGS. 5 to 18, the retainer 510, the shaft 513, the coil spring 520 and the spring receiving part 514 form a second cushioning mechanism 500 that cushions an impact caused by collision of the hammer bit 119 with the retainer 510.

Figure 4:
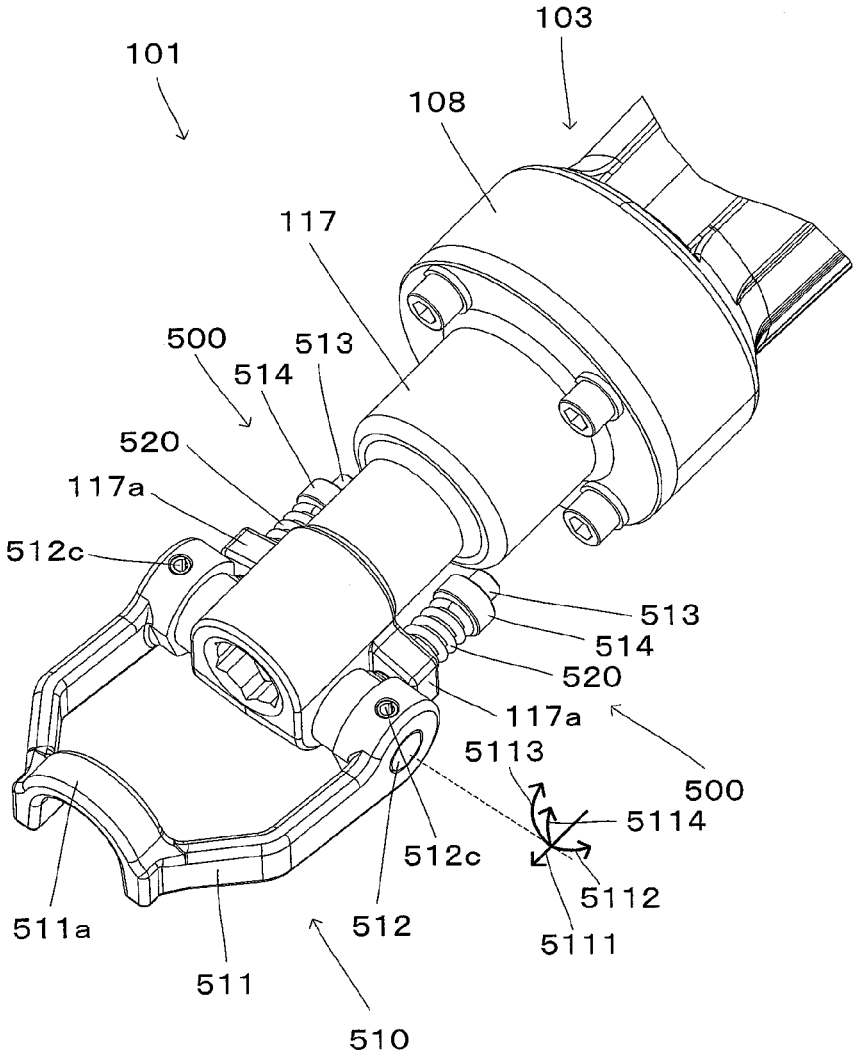
FIG. 4 is a partially enlarged perspective view showing a front end region of the electric hammer.

As shown in FIG. 4, the retainer body 511 is configured to be rotatable around the retainer shaft 512 with respect to the tool holder 117 between a replacement position for attaching and detaching the hammer bit 119 to and from the tool holder 117, and an operation position for preventing the hammer bit 119 from coming off the tool holder 117. Further, as described below with reference to FIGS. 5 to 18, in the electric hammer 101, a first hammer bit 119*a* and a second hammer bit 119*b* which have different structures can be used as the hammer bit 119. Accordingly, the retainer body 511 is configured to be rotatable to a first operation position 5111 for driving the first hammer bit 119*a* by impact, a first replacement position 5112 for replacing the first hammer bit 119*a*, a second operation position 5113 for driving the second hammer bit 119*b* by impact, and a second replacement position 5114 for replacing the second hammer bit 119*b*. The first operation position 5111 and the second operation position 5113 are example embodiments that correspond to the "operation position" according to the present invention. The first replacement position 5112 and the second replacement position 5114 are example embodiments that correspond to the "replacement position" according to the present invention.

Further, when the retainer body 511 is located in the first operation position 5111, the first replacement position 5112, the second operation position 5113 and the second replacement position 5114, the retainer body 511 is fixed to the tool holder 117 by the biasing force of the coil spring 520.

Operation of the electric hammer 101 is explained with reference to FIGS. 5 to 18. In FIGS. 5 to 18, the operation for attaching the hammer bit 119 to the electric hammer 101 and the operation of the electric hammer 101 in an "idling state" are shown. Further, in FIGS. 5 to 18, the electric hammer 101 of FIG. 1 is shown laid sideways. Therefore, in order to match the definition of directions in FIG. 1 with the definition of directions in FIGS. 5 to 18, the left and the right in FIGS. 5 to 18 are referred to as a front side or front end side and a rear side or rear end side, respectively.

In the electric hammer 101, the first hammer bit 119*a* shown in FIGS. 5 to 11 and the second hammer bit 119*b* shown in FIGS. 12 to 18 can be used as the hammer bit 119.

Figure 5:
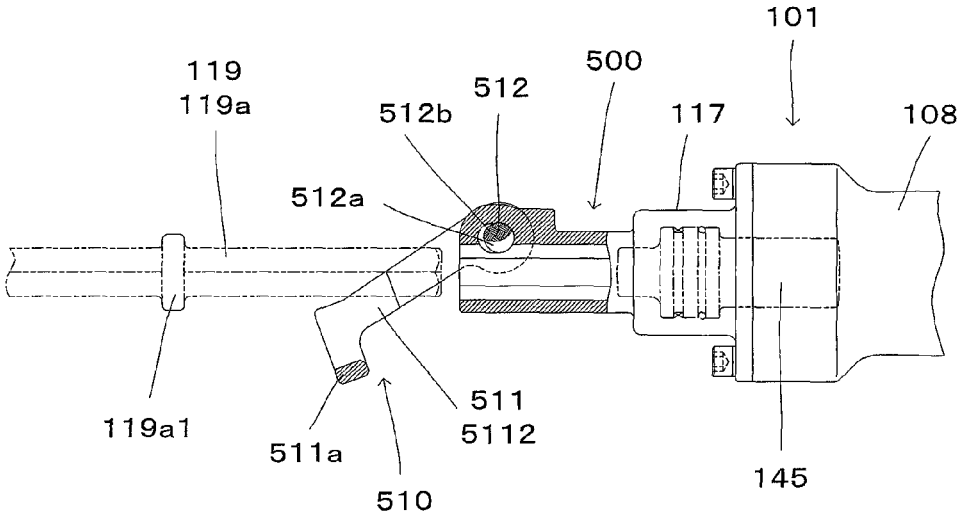
FIG. 5 is an explanatory drawing for illustrating operation of attaching a first hammer bit to the electric hammer.
Figure 6:
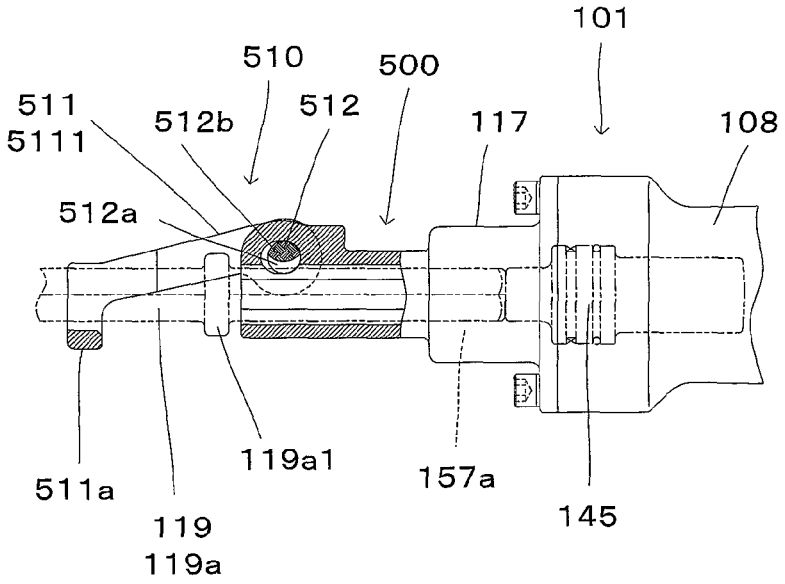
FIG. 6 is an explanatory drawing for illustrating operation of an initial stage in an idling state.
Figure 8:
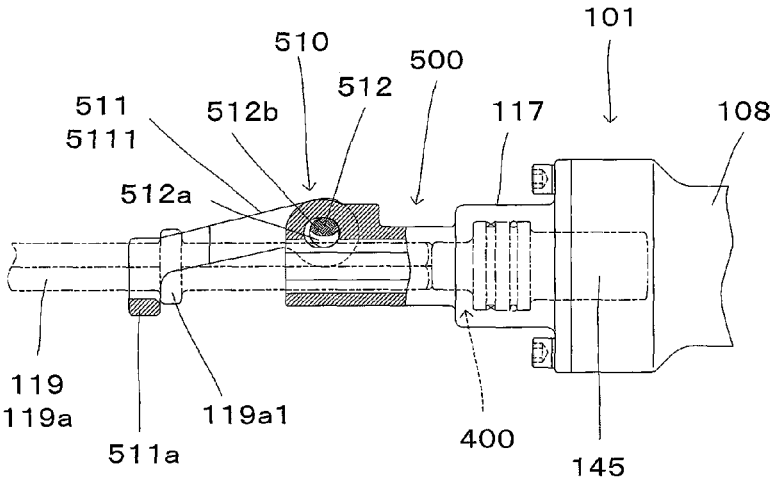
FIG. 8 is an explanatory drawing for illustrating operation when the first hammer bit is moved by an impact bolt in the idling state.

As shown in FIG. 5, the first hammer bit 119*a* has a flange 119*a*1 in its prescribed region. When the first hammer bit 119*a* is attached to the electric hammer 101, as shown in FIG. 6, the flange 119*a*1 is located between the curved part 511*a* of the retainer body 511 and the tool holder 117. Further, when the first hammer bit 119*a* is moved forward, as shown in FIG. 8, the flange 119*a*1 comes in contact with the curved part 511*a*, so that the first hammer bit 119*a* is prevented from coming off the tool holder 117. The first hammer bit 119*a*, the flange 119*a*1 and the curved part 511*a* are example embodiments that correspond to the "first tool accessory", the "flange" and the "first contact part", respectively, according to the present invention.

Figure 12:
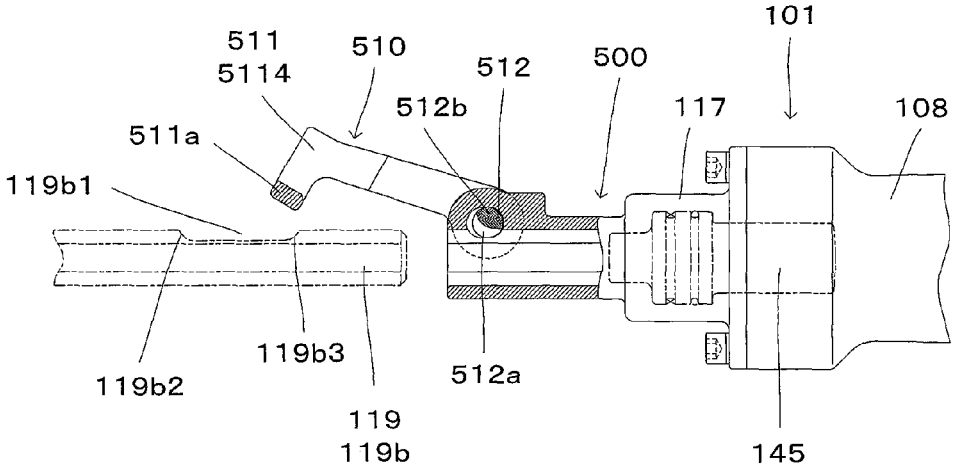
FIG. 12 is an explanatory drawing for illustrating operation when attaching a second hammer bit to the electric hammer.

As shown in FIG. 12, the second hammer bit 119*b* has a notch 119*b*1 which is formed in a prescribed region and extends in the longitudinal direction, and a pair of walls formed on both ends of the notch 119*b*1. One of the pair walls which is arranged on the front side in the second hammer bit 119*b* attached to the electric hammer 101 forms a front wall 119*b*2, and the other wall facing the front wall 119*b*2 forms a rear wall 119*b*3.

Figure 13:
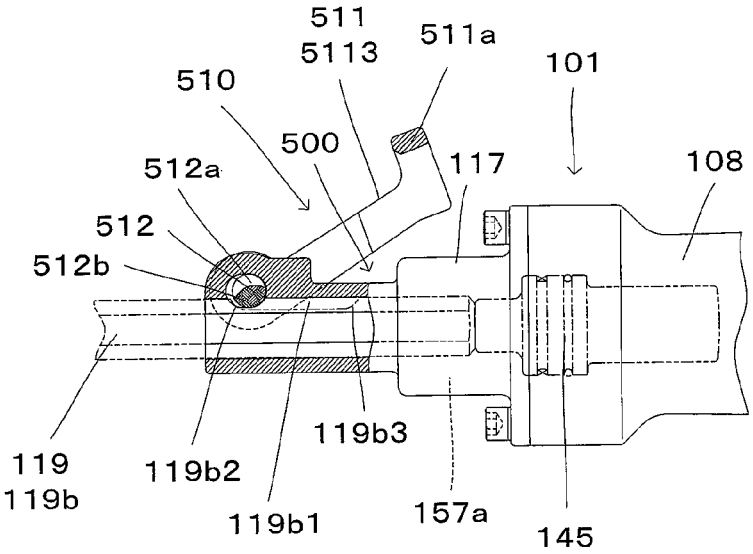
FIG. 13 is an explanatory drawing for illustrating operation of the initial stage in the idling state.
Figure 15:
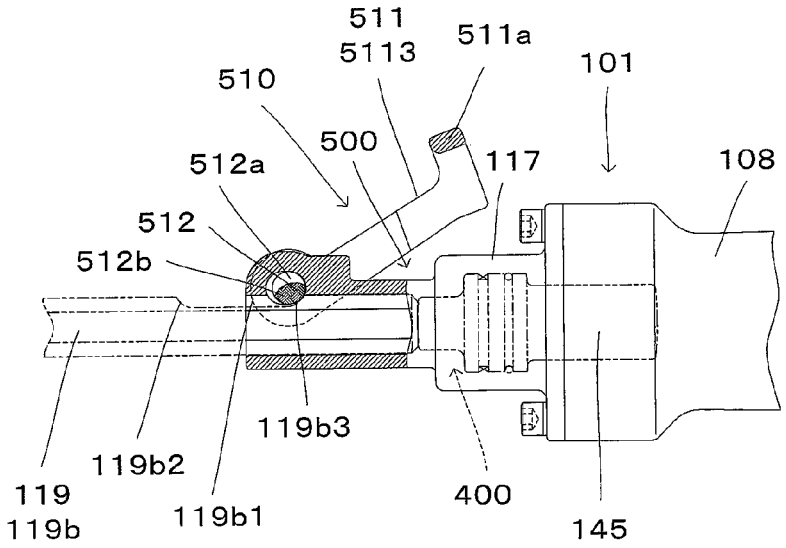
FIG. 15 is an explanatory drawing for illustrating operation when the second hammer bit is moved by the impact bolt in the idling state.

As shown in FIG. 12, the retainer shaft 512 has a notch 512*a* and a contact part 512*b* in a region including a central region in a direction crossing the longitudinal direction. When the second hammer bit 119*b* is attached to the electric hammer 101, as shown in FIG. 13, the rear wall 119*b*3 is located rearward of the retainer shaft 512 inside the tool holder 117. Further, when the second hammer bit 119*b* is moved forward, as shown in FIG. 15, the rear wall 119*b*3 comes in contact with the contact part 512*b*, so that the second hammer bit 119*b* is prevented from coming off the tool holder 117. The second hammer bit 119*b*, the rear wall 119*b*3 and the contact part 512*b* are example embodiments that correspond to the "second tool accessory", the "wall" and the "second contact part", respectively, according to the present invention.

Operation of the first hammer bit 119*a* used in the electric hammer 101 is now explained with reference to FIGS. 5 to 11.

First, FIG. 5 shows operation for attaching the first hammer bit 119*a* to the electric hammer 101. The operation for "attaching" the first hammer bit 119*a* is the same as the operation for "replacing" the first hammer bit 119*a*.

The user first turns the retainer body 511 to the first replacement position 5112. At this time, the curved part 511*a* and the contact part 512*a* are retreated to such a position as not to come in contact with the first hammer bit 119*a* when the first hammer bit 119*a* is attached to the tool holder 117. Therefore, the user is allowed to insert the rear end region of the first hammer bit 119*a* into the tool holder 117. When finishing attachment (replacement) of the first hammer bit 119*a*, the user turns the retainer body 511 to the first operation position 5111 shown in FIG. 6. In the first operation position 5111, the notch 512*a* of the retainer shaft 512 faces the first hammer bit 119*a*. Therefore, the first hammer bit 119*a* is allowed to move in the longitudinal direction without coming in contact with the contact part 512*b*.

Figure 7:
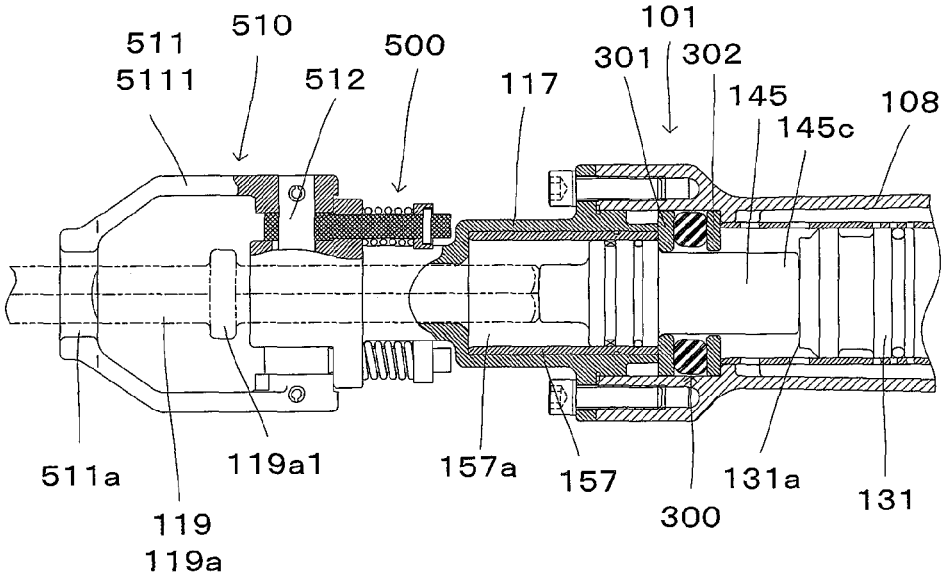
FIG. 7 is an explanatory drawing for illustrating the same operation as FIG. 6 when viewed from a different direction.

FIG. 6 shows an initial stage of the idling state. Specifically, FIG. 6 shows a state immediately after the user lifts up the electric hammer 101. FIG. 7 shows the electric hammer 101 of FIG. 6 as viewed from above in FIG. 6.

In the initial stage of this idling state, the impact bolt 145 is moved rearward by the rear end region of the first hammer bit 119*a*. In this state, as shown in FIG. 7, the striker 131 moved by the piston 129 collides with the impact bolt 145. At this time, the third region 145*c* of the impact bolt 145 is positioned by the front metal washer 301 and the rear metal washer 302 in the first cushioning mechanism 300.

Figure 9:
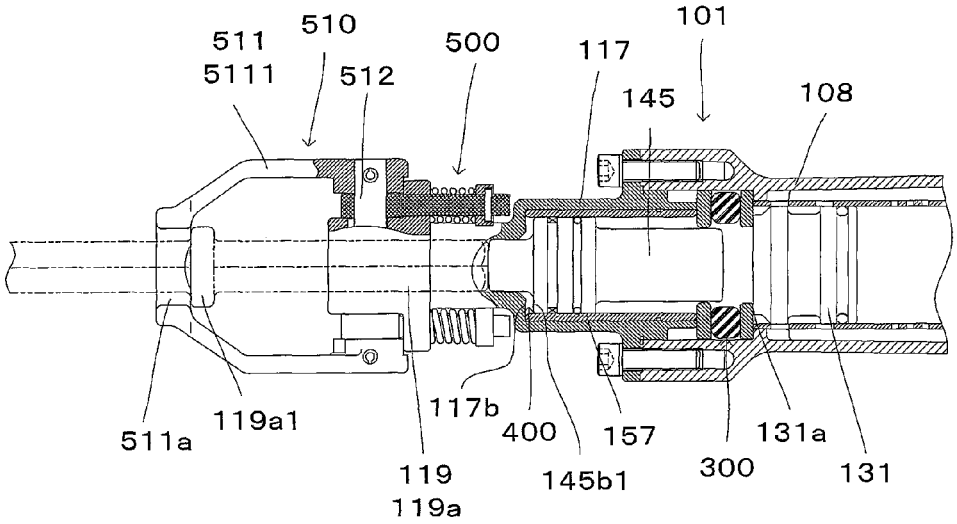
FIG. 9 is an explanatory drawing for illustrating the same operation as FIG. 8 when viewed from a different direction.

FIG. 8 shows a state in which the first hammer bit 119*a* is moved forward by the impact bolt 145. FIG. 9 shows the electric hammer 101 of FIG. 8 as viewed from above in FIG. 8. In this state, the flange 119*a*1 of the first hammer bit 119*a* is brought in contact with the curved part 511*a* and the rear end region of the first hammer bit 119*a* remains within the tool holder 117. Therefore, the first hammer bit 119*a* is prevented from coming off the electric hammer 101.

In this state, as shown in FIG. 9, the striker 131 comes in contact with the first cushioning mechanism 300. Therefore, the impact force which is applied to the tool holder 117 and the sleeve 157 by the striker 131 is cushioned. Further, the striker 131 can be prevented from bouncing off rearward, so that the striker 131 can be prevented from being driven by reciprocating movement of the piston 129.

Further, as shown in FIG. 9, the front end surface 145*b*1 of the impact bolt 145 does not come in contact with the front inner wall 117*b* of the tool holder 117 so that the remaining space 400 is maintained.

Thus, the remaining space 400 exhibits its function. Specifically, the remaining space 400 can prevent the impact bolt 145 from being bounced off the tool holder 117 and moving the striker 131 rearward. Further, it can reduce damage which is done to the tool holder 117 by the impact bolt 145.

Figure 10:
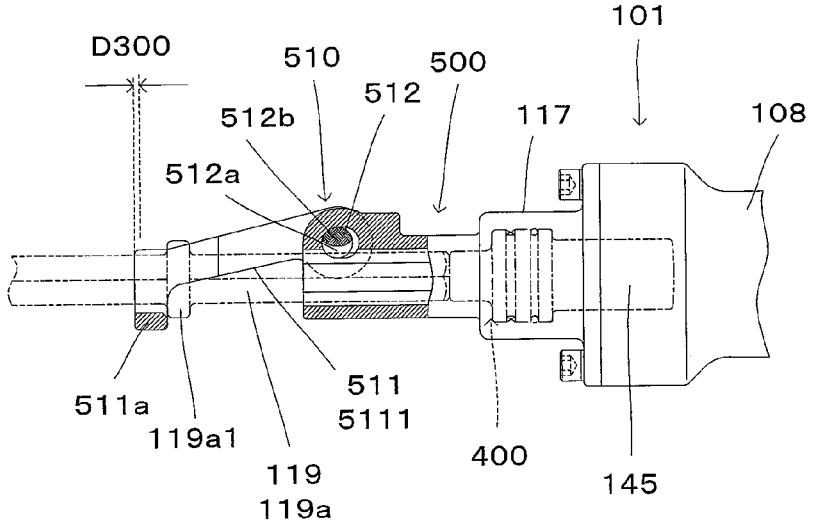
FIG. 10 is an explanatory drawing for illustrating operation when a retainer body is moved by the first hammer bit in the idling state.
Figure 11:
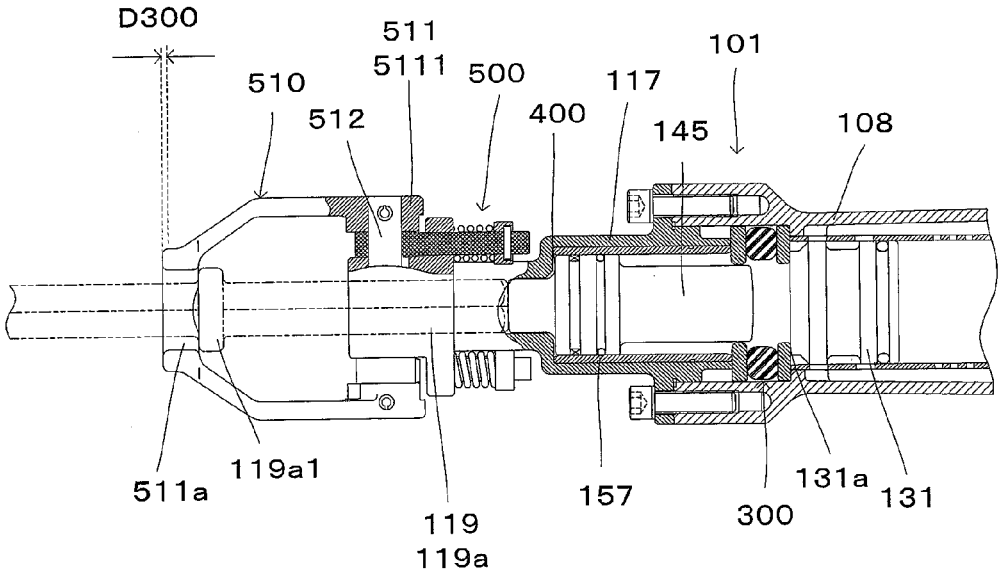
FIG. 11 is an explanatory drawing for illustrating the same operation as FIG. 10 when viewed from a different direction.

FIG. 10 shows a state in which the retainer 510 is moved forward by the first hammer bit 119*a*. FIG. 11 shows the electric hammer 101 of FIG. 10 as viewed from above in FIG. 10.

As shown in FIG. 10, the first hammer bit 119*a* is further moved forward with the flange 119*a*1 held in contact with the curved part 511*a*. As a result, the coil spring 520 contracts and the retainer 510 is moved with respect to the tool holder 117. The distance of this movement of the retainer 510 with respect to the tool holder 117 is shown as a movement distance D300 in FIGS. 10 and 11.

In this state, the second cushioning mechanism 500 exhibits its function. Specifically, the second cushioning mechanism 500 can prevent the first hammer bit 119*a* from being bounced off the retainer body 511 and moving the striker 131 rearward via the impact bolt 145. Further, it can reduce damage which is done to the retainer 510 by the first hammer bit 119*a*.

As described above, when using the first hammer bit 119*a* for the electric hammer 101, the first hammer bit 119*a* can be prevented from being driven in the idling state.

Further, the first hammer bit 119*a* returns to its original position by expansion of the coil spring 520 after moving by the movement distance D300.

Next, operation of the second hammer bit 119*b* used in the electric hammer 101 is explained with reference to FIGS. 12 to 18.

First, FIG. 12 shows operation for attaching the second hammer bit 119*b* to the electric hammer 101. The operation for "attaching" the second hammer bit 119*b* is the same as the operation for "replacing" the second hammer bit 119*b*.

The user first turns the retainer body 511 to the second replacement position 5114. At this time, the curved part 511*a* and the contact part 512*a* are retreated to such a position as not to come in contact with the second hammer bit 119*b* when the second hammer bit 119*b* is attached to the tool holder 117. Therefore, the user is allowed to insert the rear end region of the second hammer bit 119*b* into the tool holder 117. When finishing attachment (replacement) of the second hammer bit 119*b*, the user turns the retainer body 511 to the second operation position 5113 shown in FIG. 13. In the second operation position 5113, the contact part 512*b* of the retainer shaft 512 faces the second hammer bit 119*b*. More specifically, the contact part 512*b* of the retainer shaft 512 is disposed within the notch 119*b*1 of the second hammer bit 119*b*. Therefore, the second hammer bit 119*b* is allowed to reciprocate within a movement range defined by the notch 119*b*1.

Figure 14:
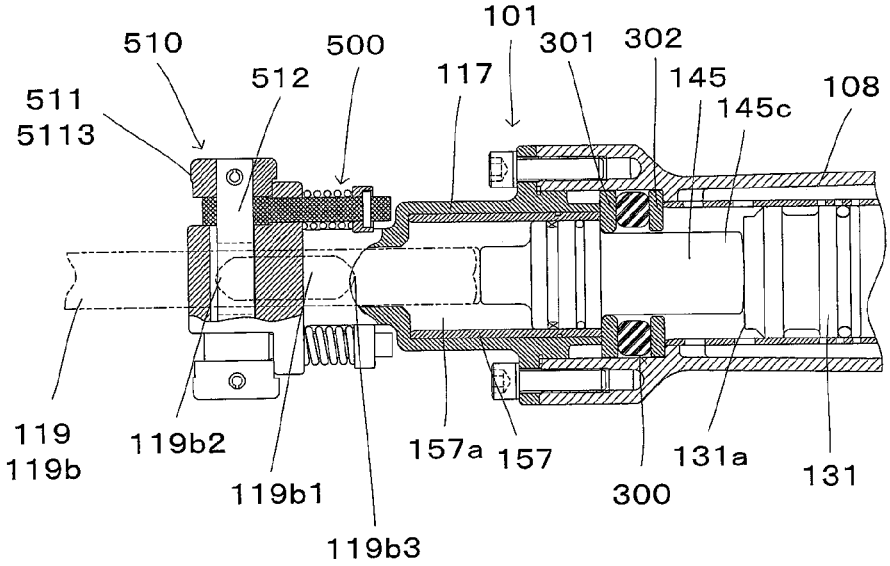
FIG. 14 is an explanatory drawing for illustrating the same operation as FIG. 13 when viewed from a different direction.

FIG. 13 shows an initial stage of the idling state. Specifically, FIG. 13 shows a state immediately after the user lifts up the electric hammer 101. FIG. 14 shows the electric hammer 101 of FIG. 13 as viewed from above in FIG. 13.

In the initial stage of this idling state, the impact bolt 145 is moved rearward by the rear end region of the second hammer bit 119*b*. Further, the contact part 512*b* of the retainer shaft 512 is not in contact with the rear wall 119*b*3 of the second hammer bit 119*b*.

In this state, as shown in FIG. 14, the striker 131 moved by the piston 129 collides with the impact bolt 145. At this time, the third region 145*c* of the impact bolt 145 is positioned by the front metal washer 301 and the rear metal washer 302 in the first cushioning mechanism 300.

Figure 16:
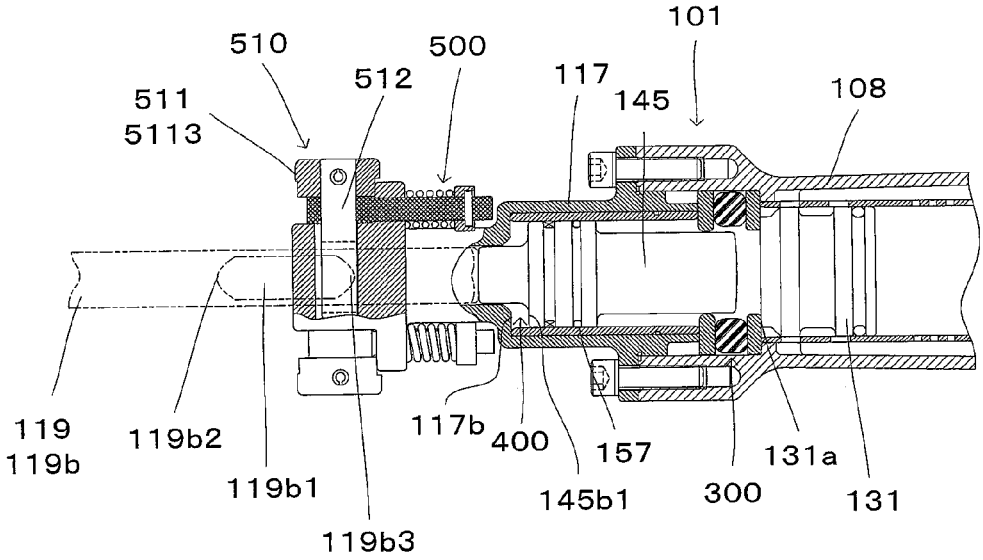
FIG. 16 is an explanatory drawing for illustrating the same operation as FIG. 15 when viewed from a different direction.

FIG. 15 shows a state in which the second hammer bit 119*b* is moved forward by the impact bolt 145. FIG. 16 shows the electric hammer 101 of FIG. 15 as viewed from above in FIG. 15. In this state, the rear wall 119*b*3 of the second hammer bit 119*b* is brought in contact with the contact part 512*b* and the rear region of the second hammer bit 119*b* remains within the tool holder 117. Therefore, the second hammer bit 119*b* is prevented from coming off the electric hammer 101.

In this state, as shown in FIG. 16, the striker 131 comes in contact with the first cushioning mechanism 300. Therefore, an impact force which is applied to the tool holder 117 and the sleeve 157 by the striker 131 is cushioned. Further, the striker 131 can be prevented from bouncing off rearward. Thus, the striker 131 can be prevented from being driven by reciprocating movement of the piston 129.

Further, as shown in FIG. 16, the front end surface 145*b*1 of the impact bolt 145 does not come in contact with the front inner wall 117*b* of the tool holder 117 so that the remaining space 400 is maintained.

Thus, the remaining space 400 exhibits its function. Specifically, the remaining space 400 can prevent the impact bolt 145 from being bounced off the tool holder 117 and moving the striker 131 rearward. Further, it can reduce damage which is done to the tool holder 117 by the impact bolt 145.

Figure 17:
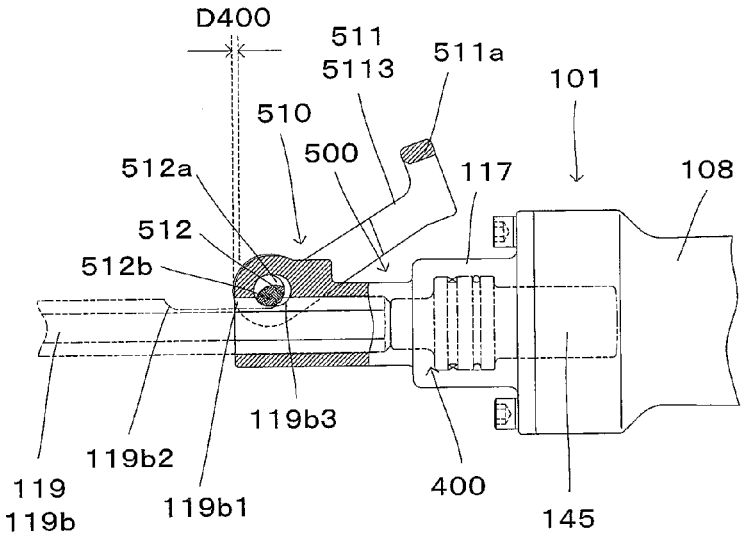
FIG. 17 is an explanatory drawing for illustrating operation when the retainer body is moved by the second hammer bit in the idling state.
Figure 18:
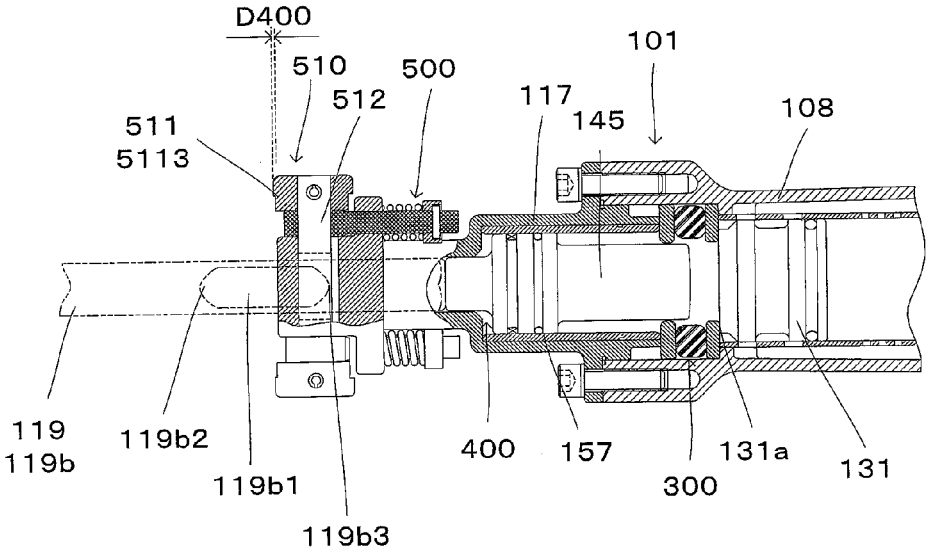
FIG. 18 is an explanatory drawing for illustrating the same operation as FIG. 17 when viewed from a different direction.

FIG. 17 shows a state in which the retainer 510 is moved forward by the second hammer bit 119*b*. FIG. 18 shows the electric hammer 101 of FIG. 17 as viewed from above in FIG. 17.

As shown in FIG. 17, the second hammer bit 119*b* is further moved forward with the rear wall 119*b*3 held in contact with the contact part 512*b*. As a result, the coil spring 520 contracts and the retainer 510 is moved with respect to the tool holder 117. The distance of this movement of the retainer 510 with respect to the tool holder 117 is shown as a movement distance D400 in FIGS. 17 and 18.

In this state, the second cushioning mechanism 500 exhibits its function. Specifically, the second cushioning mechanism 500 can prevent the second hammer bit 119*b* from being bounced off the contact part 512*b* and moving the striker 131 rearward via the impact bolt 145. Further, it can reduce damage which is done to the retainer 510 by the second hammer bit 119*b*.

As described above, when using the second hammer bit 119*b* for the electric hammer 101, the second hammer bit 119*b* can be prevented from being driven in the idling state.

Further, the second hammer bit 119*b* returns to its original position by expansion of the coil spring 520 after moving by the movement distance D400.

As described above, in the electric hammer 101 according to the first embodiment, whether the first hammer bit 119*a* is used or the second hammer bit 119*b* is used, the hammer bit 119 (119*a*, 119*b*) can be prevented from being driven by the piston 129 in the idling state.

Second Embodiment

Figure 19:
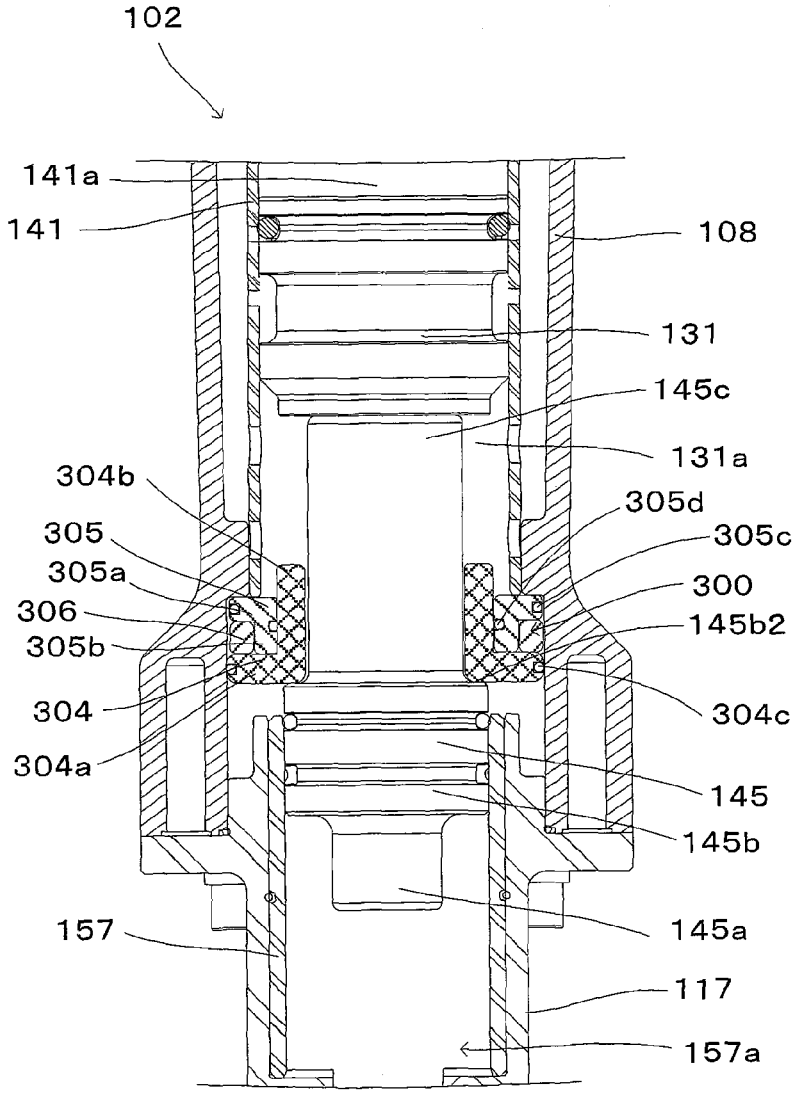
FIG. 19 is an explanatory drawing for illustrating a structure of an electric hammer according to a second embodiment of the present invention.
Figure 20:
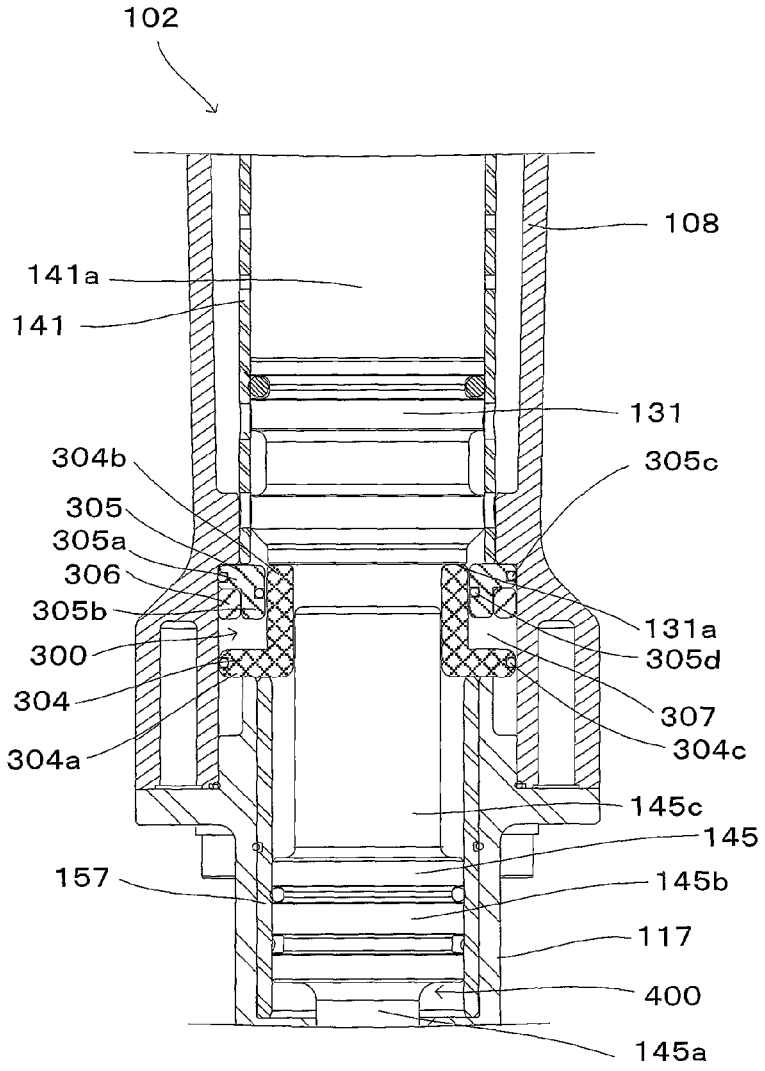
FIG. 20 is an explanatory drawing for illustrating operation of the electric hammer.

A second embodiment of the impact tool according to the present invention is now described based on an electric hammer 102 with reference to FIGS. 19 and 20. FIGS. 19 and 20 are enlarged sectional views showing an essential part of the electric hammer 102. For the sake of convenience, the hammer bit 119 is not shown in FIGS. 19 and 20.

In the electric hammer 102, components or elements which are substantially identical to those in the first embodiment are given like numerals and are not described. The electric hammer 102 is different from the electric hammer 101 of the first embodiment in the structure of the first cushioning mechanism 300.

As shown in FIG. 19, the first cushioning mechanism 300 of the electric hammer 102 mainly includes a movable member 304, a fixed member 305 and a rubber ring 306. The movable member 304 and the fixed member 305 are made of metal.

The movable member 304 has a first extending part 304*a* that extends in a direction crossing the longitudinal direction, and a second extending part 304*b* that extends from an inner region of the first extending part 304*a* toward the striker 131 in the longitudinal direction. The movable member 304 is configured to be movable in the longitudinal direction. An end of the first extending part 304*a* facing the barrel 108 is configured to be held in contact with an inner wall of the barrel 108 and is provided with a sealing member 304*c* such as an O-ring. The movable member 304 is an example embodiment that corresponds to the "movable member" according to this invention.

The fixed member 305 has a first extending part 305*a* that extends in a direction crossing the longitudinal direction, and a second extending part 305*b* that extends from an inner region of the first extending part 305*a* toward the hammer bit 119 in the longitudinal direction. An end of the first extending part 305*a* is fixed to the inner wall of the barrel 108. An end of the first extending part 305*a* facing the barrel 108 is configured to be held in contact with the inner wall of the barrel 108 and is provided with a sealing member 305*c* such as an O-ring. Further, a region of the first extending part 305*a* facing the movable member 304 is configured to be held in contact with the movable member 304 and is provided with a sealing member 305*d* such as an O-ring.

The rubber ring 306 is fixed in a space surrounded by the inner wall of the barrel 108 and the first extending part 305*a* and the second extending part 305*b* of the fixed member 305. A front end surface of the rubber ring 306 slightly protrudes forward from a front end surface of the second extending part 305*b* of the fixed member 305 in the longitudinal direction.

Operation of the electric hammer 102 is now explained with reference to FIGS. 19 and 20. FIG. 19 shows an initial stage of the idling state or a state immediately after the user lifts up the electric hammer 102. In this state, the impact bolt 145 is moved rearward by the rear region of the hammer bit 119 (not shown). Therefore, a rear end surface 145*b*2 of the second region 145*b* of the impact bolt 145 comes in contact with the first extending part 304*a* of the movable member 304, so that the impact bolt 145 pushes up the movable member 304 rearward.

In this state, as shown in FIG. 19, the striker 131 moved by the piston 129 collides with the impact bolt 145. At this time, the third region 145*c* of the impact bolt 145 is positioned by the second extending part 304*b* of the movable member 304 in the first cushioning mechanism 300.

FIG. 20 shows a state in which the hammer bit 119 (not shown) is move forward by the impact bolt 145. In this state, the front end region 131*a* of the striker 131 moves the second extending part 304*b* of the movable member 304 forward, so that the movable member 304 exhibits its function as the first cushioning mechanism 300.

Specifically, in the process in which the striker 133 moves the movable member 304 forward as shown in FIG. 20 from a state shown in FIG. 19 in which the striker 131 is held in contact with the impact bolt 145, a space 307 is formed between the fixed member 305 and the rubber ring 306, and the movable member 304. In other words, the movable member 304 is moved forward while forming the space 307 between the fixed member 305 and the rubber ring 306, and the movable member 304. The space 307 is formed in a region surrounded by the sealing members 304*c*, 305*c*, 305*d*, so that negative pressure is generated in the space 307. Therefore, the movable member 304 is moved forward while being decelerated.

When the movable member 304 is moved forward, the first extending part 304*a* of the movable member 304 comes in contact with rear ends of the tool holder 117 and the sleeve 157. At this time, the movable member 304 comes in contact with the rear ends of the tool holder 117 and the sleeve 157 while being decelerated, so that the impact applied to the tool holder 117 and the sleeve 157 by the movable member 304 is reduced. Further, the impact caused by collision of the first extending part 304*a* of the movable member 304 with the tool holder 117 and the sleeve 157 is dispersed to the tool holder 117 and the sleeve 157.

Moreover, since the movable member 304 moves while being decelerated, reaction force caused by collision of the movable member 304 with the tool holder 117 and the sleeve 157 is reduced. As a result, the striker 131 can be prevented from bouncing off rearward.

The electric hammer 102 further has the remaining space 400 and the second cushioning mechanism 500 which have the same structures as those of the electric hammer 101 of the first embodiment. Therefore, also in the electric hammer 102, like in the electric hammer 101, the hammer bit is not driven in the idling state.

In a normal operation state, the movable member 304 is reciprocated between the position shown in FIG. 19 and the position shown in FIG. 20 by reciprocating movement of the striker 131, the impact bolt 145 and the hammer bit 119 when the piston 129 is driven. In the reciprocating movement of the movable member 304, when the movable member 304 moves from the position shown in FIG. 20 to the position shown in FIG. 19, the first extending part 304*a* of the movable member 304 comes in contact with the rubber ring 306 and the rubber ring 306 cushions the impact caused by collision with the movable member 304. In other words, when the movable member 304 moves from the position shown in FIG. 20 to the position shown in FIG. 19, the movable member 304 does not collide with the fixed member 305. Therefore, vibration or noise caused by collision between the movable member 304 and the fixed member 305 which are both made of metal can be reduced.

In view of the nature of the above-described invention, the following features can be provided.

(Aspect 1)

The impact tool as defined in any one of claims 1 to 9, wherein the striker cushioning part forms a first cushioning mechanism, the structure in which the impact bolt does not come in contact with the tool accessory holder in the longitudinal direction forms a remaining space, and the elastic member forms a second cushioning mechanism.

(Aspect 2)

The impact tool as defined in any one of claims 1 to 9, wherein a space is formed between the impact bolt and the tool holder and the space exists even when the impact bolt comes in contact with the tool accessory.

(Correspondences Between the Features of the Embodiments and the Features of the Invention)

The above-described embodiments are representative examples for embodying the present invention, and the present invention is not limited to the constructions that have been described as the representative embodiments. Correspondences between the features of the embodiments and the features of the invention are as follow:

The tool bit 119 is an example embodiment that corresponds to the "tool accessory" according to the present invention. The electric hammer 101 is an example embodiment that corresponds to the "impact tool" according to the present invention. The tool holder 117 is an example embodiment that corresponds to the "tool accessory holder" according to the present invention. The striker 131 is an example embodiment that corresponds to the "striker" according to the present invention. The impact bolt 145 is an example embodiment that corresponds to the "impact bolt" according to the present invention. The first cushioning mechanism 300 is an example embodiment that corresponds to the "striker cushioning part" and the "positioning element" according to the present invention. The retainer 510 is an example embodiment that corresponds to the "tool accessory retainer" according to the present invention. The retainer body 511 is an example embodiment that corresponds to the "retainer body" according to the present invention. The retainer shaft 512 is an example embodiment that corresponds to the "retainer shaft" according to the present invention. The coil spring 520 is an example embodiment that corresponds to the "elastic element" and the "biasing element" according to the present invention. The first operation position 5111 and the second operation position 5113 are example embodiments that correspond to the "operation position" according to the present invention. The first replacement position 5112 and the second replacement position 5114 are example embodiments that correspond to the "replacement position" according to the present invention. The first hammer bit 119*a* is an example embodiment that corresponds to the "first tool accessory" according to the present invention. The flange 119*a*1 is an example embodiment that corresponds to the "flange" according to the present invention. The curved part 511*a* is an example embodiment that corresponds to the "first contact part" according to the present invention. The second hammer bit 119*b* is an example embodiment that corresponds to the "second tool accessory" according to the present invention. The rear wall 119*b*3 is an example embodiment that corresponds to the "wall" according to the present invention. The contact part 512*b* is an example embodiment that corresponds to the "second contact part" according to the present invention. The movable member 304 is an example embodiment that corresponds to the "movable member" according to the present invention.

DESCRIPTION OF THE NUMERALS

101, 102 electric hammer (power tool)
103 body
103*a* power cord
105 motor housing
107 gear housing
108 barrel
109 handgrip
109*a* operation button
109*b* cord holding part
109*b*1 projection
109*b*2 space
110 driving motor
111 rotary shaft
113 first motion converting mechanism
115 striking mechanism
117 tool holder (tool accessory holder)
117*a* projection
117*a*1 hole
117*a*2 front end region
117*b* front inner wall
119 hammer bit (tool accessory)
119*a* first hammer bit (first tool accessory)
119*a*1 flange
119*b* second hammer bit (second tool accessory)
119*b*1 notch
119*b*2 front wall
119*b*3 rear wall
121 driving gear
122 intermediate gear
123 driven gear
124 first crank disk
125 first eccentric shaft
126 first connecting rod
127 first connecting shaft
129 piston
131 striker
131*a* front end region
141 cylinder
141*a* first air chamber
145 impact bolt
145*a* first region

145*b* second region
145*b*1 front end surface
145*b*2 rear end surface
145*c* third region
157 sleeve
157*a* space
201 vibration reducing mechanism part
213 second motion converting mechanism
221 second crank disk
221*a* engagement part
222 third crank disk
223 second eccentric shaft
225 second connecting rod
227 counter weight
227*a* sliding guide
300 first cushioning mechanism (striker cushioning part, positioning element)
300*a* hole
301 front metal washer
302 rear metal washer
303 rubber ring
304 movable member
304*a* first extending part
304*b* second extending part
304*c* sealing member
305 fixed member
305*a* first extending part
305*b* second extending part
305*c* sealing member
305*d* sealing member
306 rubber ring
307 space
400 remaining space
500 second cushioning mechanism
510 retainer (tool accessory retainer)
511 retainer body
511*a* curved part (first contact part)
511*b* opening
511*c* hole
511*d* rear end region
5111 first operation position
5112 first replacement position (replacement position)
5113 second operation position
5114 second replacement position (replacement position)
512 retainer shaft
512*a* notch
512*b* contact part (second contact part)
513 shaft
513*a* hole
514 spring receiving part
520 coil spring (elastic element, biasing element)
D100 first distance
D200 second distance
D300 movement distance
D400 movement distance

What we claim is:

1. An impact tool, which performs a prescribed hammering operation on a workpiece by moving a tool accessory in a longitudinal direction of the tool accessory, comprising:

a striker that linearly moves in the longitudinal direction, an impact bolt that is driven by the striker and transmits a striking force to the tool accessory, a tool accessory holder that holds the tool accessory such that the tool accessory can move in the longitudinal direction, a tool accessory retainer that is provided in an end region of the tool accessory holder and prevents the tool accessory from coming off the tool accessory holder, and an elastic element that connects the tool accessory holder and the tool accessory retainer such that the tool accessory holder and the tool accessory retainer can move in the longitudinal direction with respect to each other, wherein:

in an idling state defined as a state in which the tool accessory is not pressed against the workpiece and the impact bolt transmits the striking force to the tool accessory, the tool accessory retainer moves with respect to the tool accessory holder by movement of the tool accessory in the longitudinal direction, whereby the striking force is cushioned.

2. The impact tool as defined in claim 1, wherein the impact bolt is avoided from coming in contact with the tool accessory holder in the longitudinal direction in the idling state, whereby the striking force of the impact bolt can be prevented from being transmitted to the tool accessory holder in the idling state.

3. The impact tool as defined in claim 1, wherein the elastic element comprises a coil spring.

4. The impact tool as defined in claim 1, wherein the tool accessory retainer has a retainer body and a retainer shaft, and is configured to be rotatable around the retainer shaft between a replacement position for attaching and detaching the tool accessory to and from the tool accessory holder and an operation position for preventing the tool accessory from coming off the tool accessory holder.

5. The impact tool as defined in claim 4, wherein the retainer shaft prevents the tool accessory from coming off the tool accessory holder by engagement with the tool accessory when the tool accessory moves in the longitudinal direction.

6. The impact tool as defined in claim 5, wherein:

the tool accessory defines a first tool accessory that has a flange on a tool accessory body and a second tool accessory that has a notch extending in the longitudinal direction in the tool accessory body and has a pair of walls formed on both ends of the notch, and in the tool accessory retainer, the retainer body has a first contact part that comes in contact with the flange when the first tool accessory moves in the longitudinal direction, and the retainer shaft has a second contact part that comes in contact with the walls when the second tool accessory moves in the longitudinal direction, whereby the impact tool is configured such that the first and second tool accessories can be replaced with each other.

7. The impact tool as defined in claim 4, comprising a biasing element which pulls up the retainer shaft toward the tool accessory holder and thereby fixes the tool accessory retainer with respect to the tool accessory holder in the operation position, wherein the biasing element also serves as the elastic element.

8. The impact tool as defined in claim 1, comprising a striker cushioning part for cushioning an impact caused by the striker when the striker moves toward the tool accessory, wherein the striker cushioning part also serves as a positioning element when the impact bolt is driven by the striker.

9. The impact tool as defined in claim 8, wherein the striker cushioning part has a movable member that can move in the longitudinal direction, and the movable member is moved in a direction away from the tool accessory when the striker comes in contact with the impact bolt, while the movable member is moved in a direction toward the tool accessory when pressed by the striker.

* * * * *